US006581339B2

(12) United States Patent
Thiede

(10) Patent No.: US 6,581,339 B2
(45) Date of Patent: Jun. 24, 2003

(54) ERECTABLE PLATFORM

(75) Inventor: Martin E. Thiede, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 146 days.

(21) Appl. No.: 09/833,779

(22) Filed: Apr. 12, 2001

(65) Prior Publication Data

US 2002/0116885 A1 Aug. 29, 2002

Related U.S. Application Data

(60) Provisional application No. 60/268,488, filed on Feb. 13, 2001.

(51) Int. Cl.[7] ..... E04B 2/82

(52) U.S. Cl. ..... 52/126.4; 52/6; 52/7; 52/263; 407/6; 407/7; 407/388; 411/84; 411/85

(58) Field of Search ..... 52/6, 7, 64, 263; 411/84, 85; 403/6, 7, 388, 403

(56) References Cited

U.S. PATENT DOCUMENTS

| | | | | | |
|---|---|---|---|---|---|
| 2,841,831 | A | | 7/1958 | Mackintosh | |
| 3,150,748 | A | | 9/1964 | Liskey | |
| 3,157,254 | A | | 11/1964 | Spiselman | |
| 3,180,460 | A | | 4/1965 | Liskey | |
| 3,181,203 | A | * | 5/1965 | Wenger | 52/6 |
| 3,258,884 | A | | 7/1966 | Wenger | |
| 3,425,179 | A | | 2/1969 | Haroldson | |
| 3,470,663 | A | | 10/1969 | Tate | |
| 3,606,704 | A | | 9/1971 | Denton | |
| 3,964,402 | A | | 6/1976 | Jenne | |
| 4,054,096 | A | | 10/1977 | Wilson | |
| 4,327,650 | A | | 5/1982 | Bue | |
| 4,638,604 | A | | 1/1987 | Rogers | |
| 4,656,795 | A | | 4/1987 | Albrecht | |
| 4,676,036 | A | | 6/1987 | Bessert | |
| 4,759,162 | A | | 7/1988 | Wyse | |
| 4,811,530 | A | | 3/1989 | Eyerly | |
| 4,901,490 | A | | 2/1990 | Zinniel | |
| 4,942,708 | A | | 7/1990 | Krumholz | |
| 4,949,649 | A | | 8/1990 | Terres | |
| 4,988,131 | A | | 1/1991 | Wilson | |
| 5,022,200 | A | | 6/1991 | Wilson | |
| 5,205,087 | A | | 4/1993 | Jines | |
| 5,325,640 | A | | 7/1994 | Luedke | |
| 5,349,789 | A | | 9/1994 | Andert | |
| 5,392,718 | A | | 2/1995 | Stevens | |
| 5,746,561 | A | * | 5/1998 | Nygren et al. | 411/368 |
| 5,848,501 | A | | 12/1998 | Taipale | |
| 6,006,680 | A | | 12/1999 | Quam | |
| 6,014,936 | A | | 1/2000 | Rogers | |
| 6,106,186 | A | | 8/2000 | Taipale | |

* cited by examiner

*Primary Examiner*—Carl D. Friedman
*Assistant Examiner*—Steve M Varner
(74) *Attorney, Agent, or Firm*—Patterson, Thuente, Skaa & Christensen, P.A.

(57) ABSTRACT

An erectable platform includes at least one bay, the bay having; at least one deck assembly, the deck assembly having a plurality of threaded couplers. The platform further includes support structure having at least two spaced apart main beams and at least two intermediate beams, each of said main beams underlying each of the at least one deck assemblies in a supporting disposition, each of said main beams presenting a first elongate, upward directed threaded receiver, the threaded receiver having two spaced apart rails defining a slot between the two rails, and each of said intermediate beams extending between two of the at least two main beams and being operably removably coupled thereto, and a plurality of depending columns operably removably coupled to the support structure in a supporting disposition.

44 Claims, 16 Drawing Sheets

12
30
34
58
36
32
64
56
40
38
80
78
54
68
98
104
104
48
106
102
106
102
110
108
112
112
114
114
14
90
96
94
100
114
114
116
116

ERECTABLE PLATFORM

RELATED APPLICATIONS

The present invention claims the benefit of U.S. Provisional Application 60/268,488 filed Feb. 13, 2001 and incorporated herein by reference in its entirety.

TECHNICAL FIELD

The present invention relates to a semi-permanent platform that may be readily erected and disassembled as desired. More particularly, the present invention relates to a platform that may be used as a pit filler utilized to extend a stage surface over the pit in front of the stage.

BACKGROUND OF THE INVENTION

There is a need in the industry for platforms that are readily erectable and disassembled. Such platforms are used as pit fillers or as stage extensions to create, for example, a runway extending outward from either the pit filler or the main stage surface. Additional uses for such platforms are in multi-use facilities. For example, an assembly hall may be converted into a place of worship by incorporating an erectable platform for use as a sanctuary during the worship service. Another use is to install an erectable platform on a basketball surface to use a basketball arena for a large event such as a graduation ceremony or the like.

There is a need in the industry for erectable platforms of this type that may be readily assembled and disassembled, may accommodate a plurality of rectangular and non-rectangular applications, be adjustable in height, be sturdy, and accommodate a number of safety features to ensure the safety of both the individual erecting and disassembling the erectable platform and those individuals that are performing on the surface of the erectable platform.

SUMMARY OF THE INVENTION

The present invention substantially meets the aforementioned needs of the industry. The erectable platform of the present invention includes a number of features that enhance the speed and safety with which the erectable platform is both erected and disassembled. Further, the erectable platform is designed to accommodate non-linear and non-rectangular exterior margins. The erectable platform is designed in a plurality of side by side interlocked bays that facilitate the use of components that are easily handled yet, when fully assembled, will span a considerable surface area. A number of adjustments are available to accommodate relatively minor misalignments of components and mismeasurements of the area in which the erectable platform is to be erected.

The present invention is an erectable platform that includes at least one bay, the bay having; at least one deck assembly, the deck assembly having a plurality of threaded couplers. The platform further includes support structure having at least two spaced apart main beams and at least two intermediate beams, each of said main beams underlying each of the at least one deck assemblies in a supporting disposition, each of said main beams presenting a first elongate, upward directed threaded receiver, the threaded receiver having two spaced apart rails defining a slot between the two rails, and each of said intermediate beams extending between two of the at least two main beams and being operably removably coupled thereto, and a plurality of depending columns operably removably coupled to the support structure in a supporting disposition.

DETAILED DESCRIPTION OF THE DRAWINGS

Figure 1:
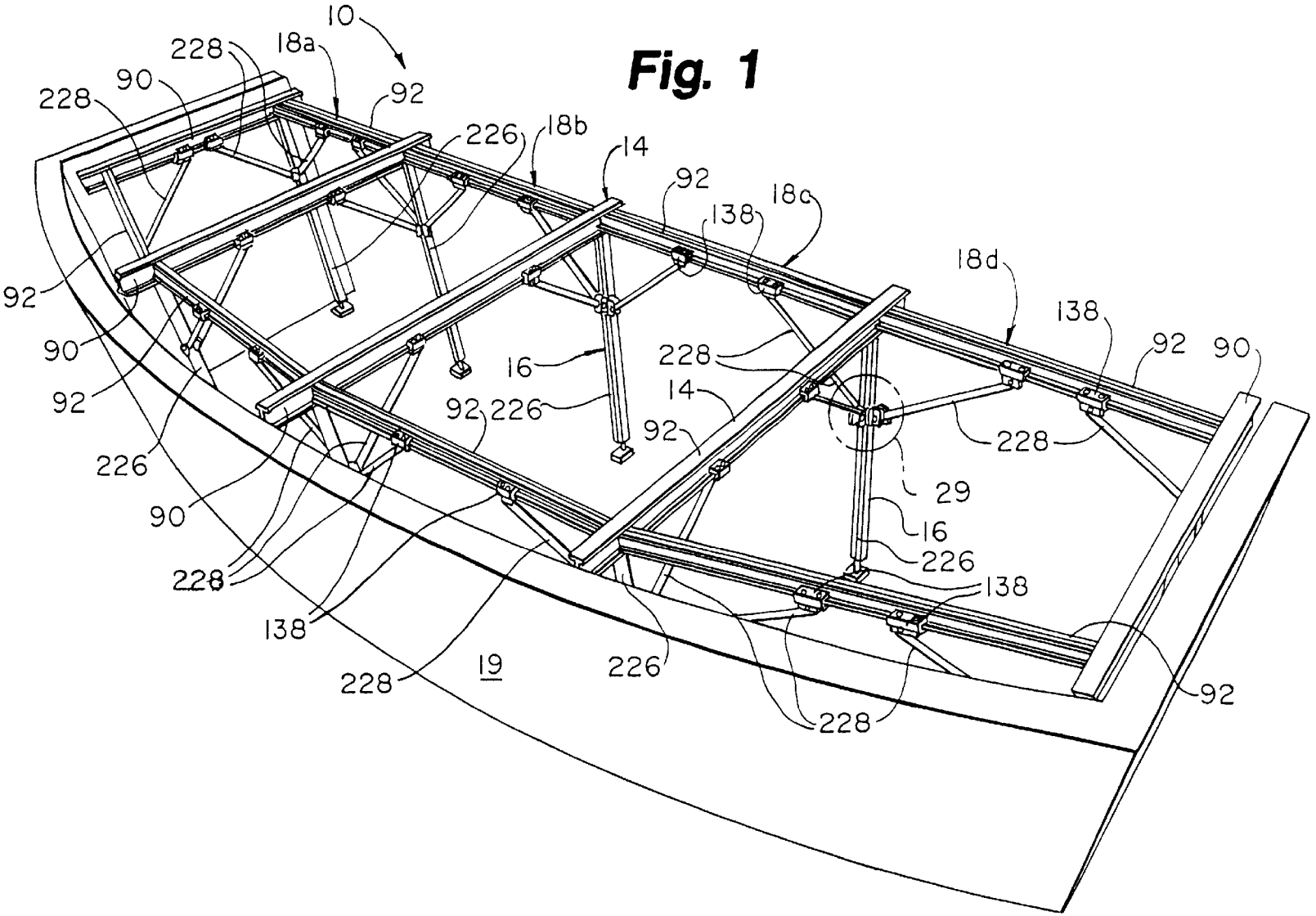
FIG. 1 is a perspective view of the erectable platform of the present invention disposed within the curvilinear confines of a stage pit structure, the deck assemblies not having been installed.
Figure 2:
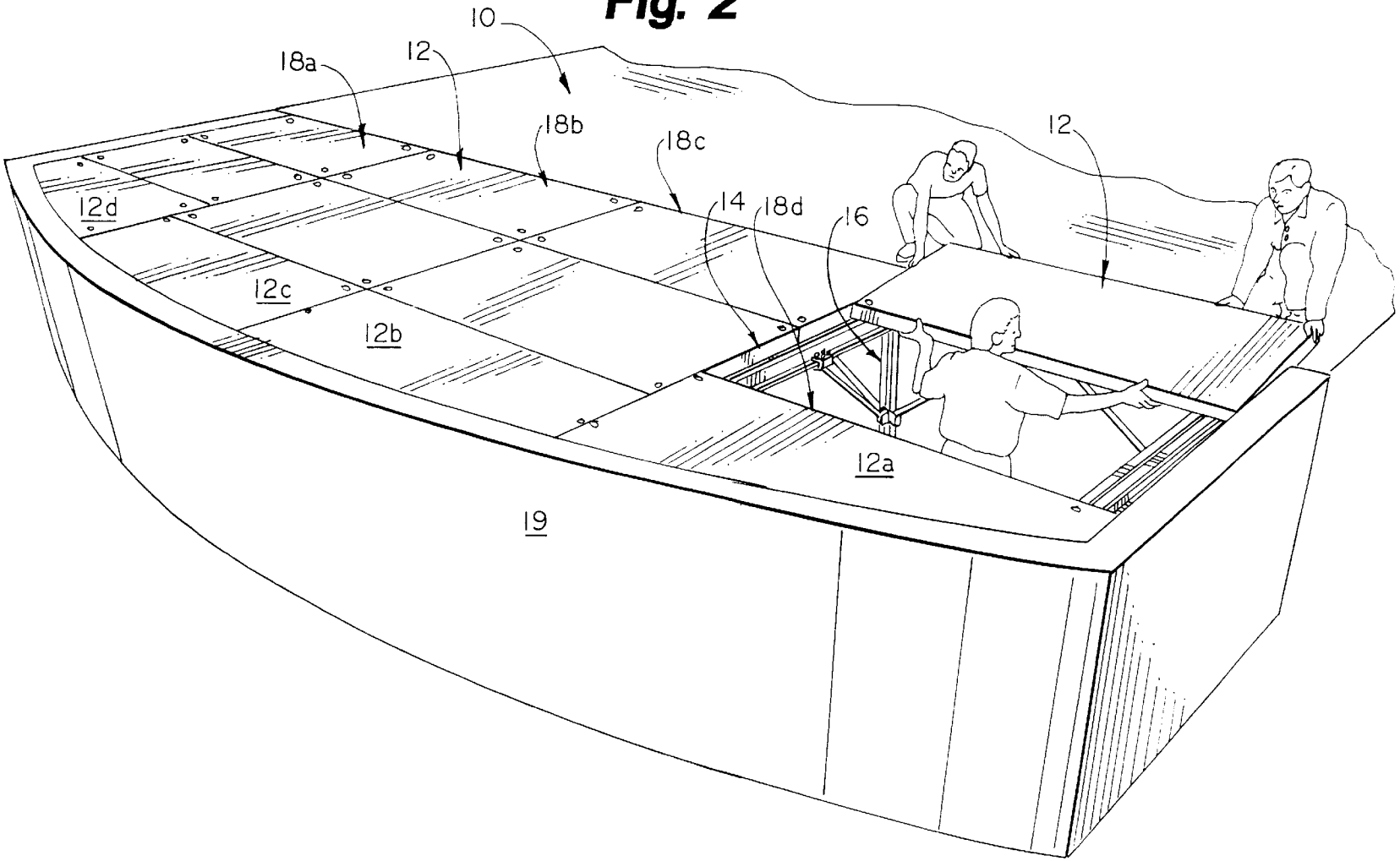
FIG. 2 is a perspective view of the erectable platform of FIG. 1 with the deck assemblies being installed by installers.
Figure 38:
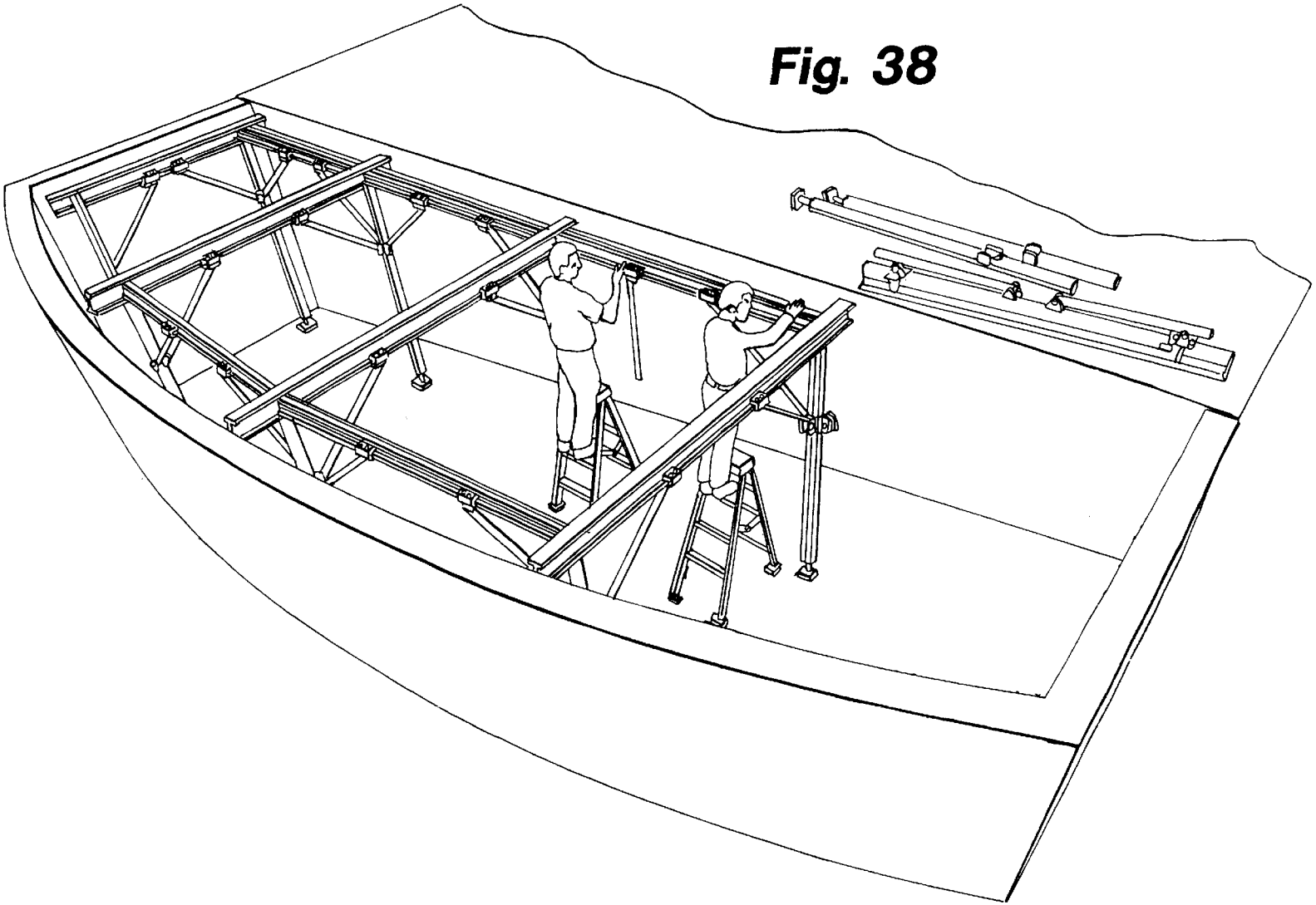
FIG. 38 is a perspective view of the support structure of the erectable platform during assembly.

The erectable platform of the present invention is shown generally at 10 in the Figs. The erectable platform 10 has three major components; deck assemblies 12, support structure 14, and column assembly 16, including braces. As depicted in FIGS. 1,2, and 38 the erectable platform 10 is formed of a plurality of side-by-side interconnected bays 18. In the depiction of FIGS. 1, 2, and 38, there are 4 bays, 18*a*–18*d*. It is understood that more or fewer bays 18 could be utilized in a single erectable platform 10 as needed. As depicted in FIG. 2, a plurality of deck assemblies 12 may be installed in each bay 18. Where possible, a standardized deck assembly 12 such as the deck assembly 12 being maneuvered into position by the assemblers, is utilized. The deck assemblies 12*a*–12*d* are specially formed with curvilinear margins to accommodate the curvilinear front margin of the pit 19. In this manner, the erectable platform 10 is able to accommodate and be formed in a plurality of different planform shapes.

Figure 3:
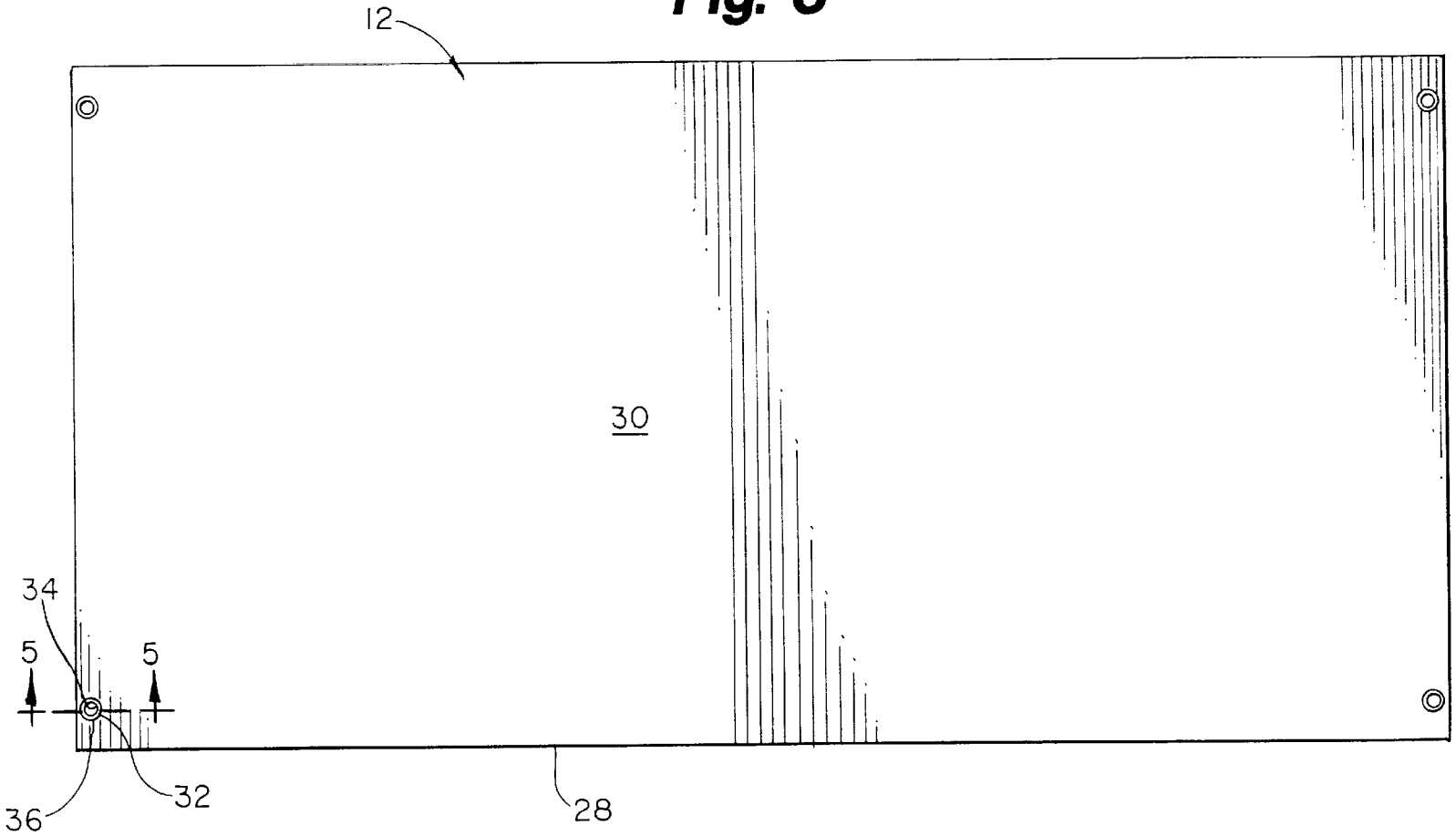
FIG. 3 is a top planform view of a single, standard deck assembly.
Figure 4:
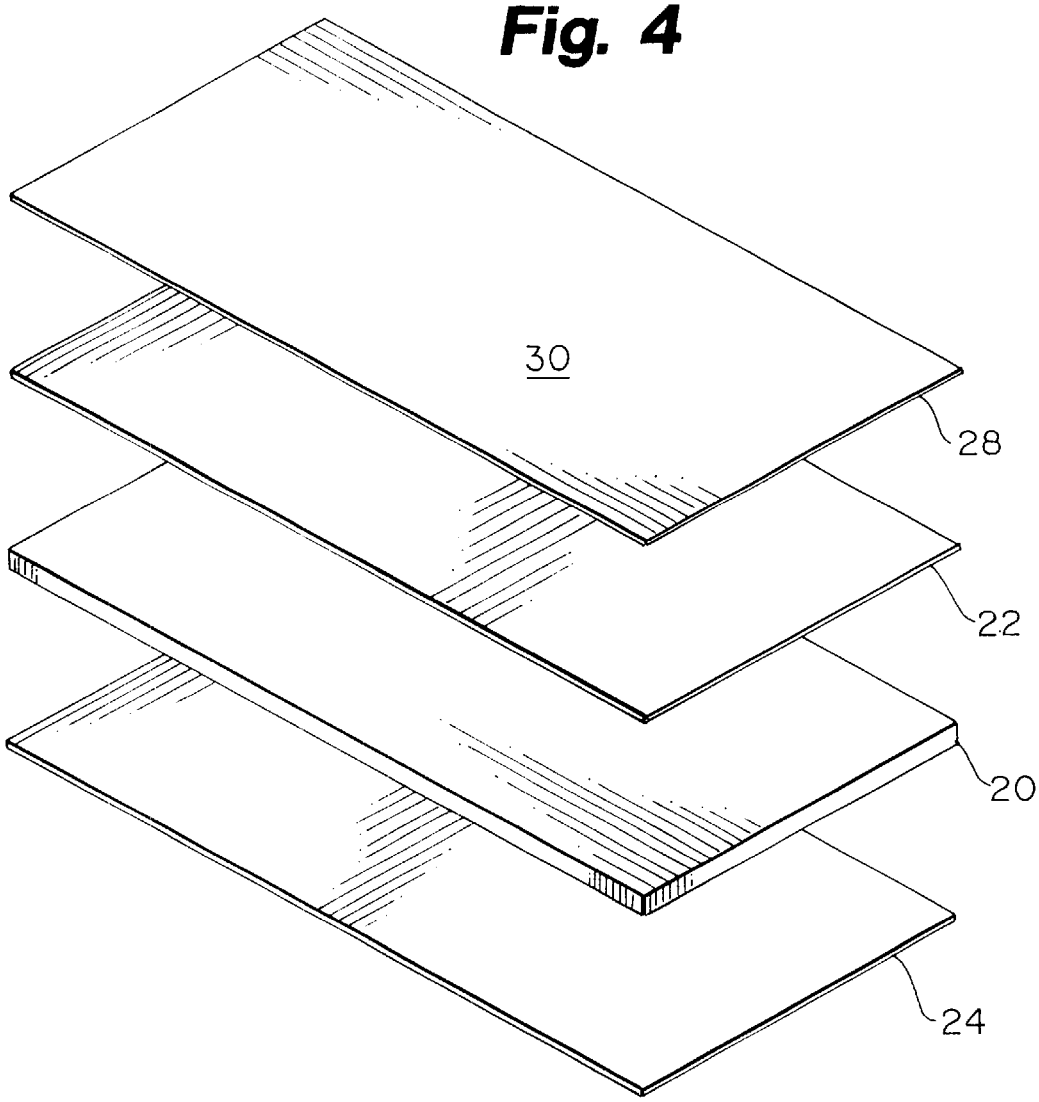
FIG. 4 is an exploded view of the deck assembly of FIG. 3.
Figure 5:
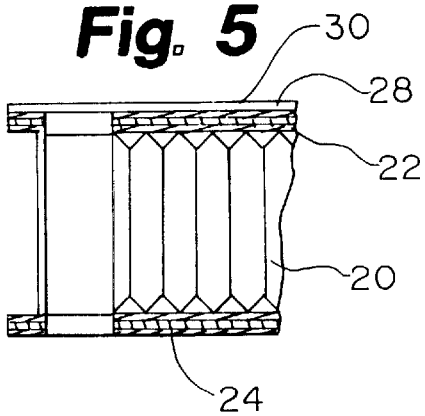
FIG. 5 is a sectional view of a portion of the deck assembly of FIG. 3 taken along section line A—A.

A standard deck assembly 12 of the erectable platform 10 is depicted in FIGS. 3–6. The deck assembly 12 is preferably four by eight feet in a rectangular configuration. A preferably hardboard upward directed surface 30 as depicted in FIG. 3 is provided for the performers to walk on. Other surfaces may be overlaid on the hardboard surface 30, such as for example carpet, where desired.

Figure 6:
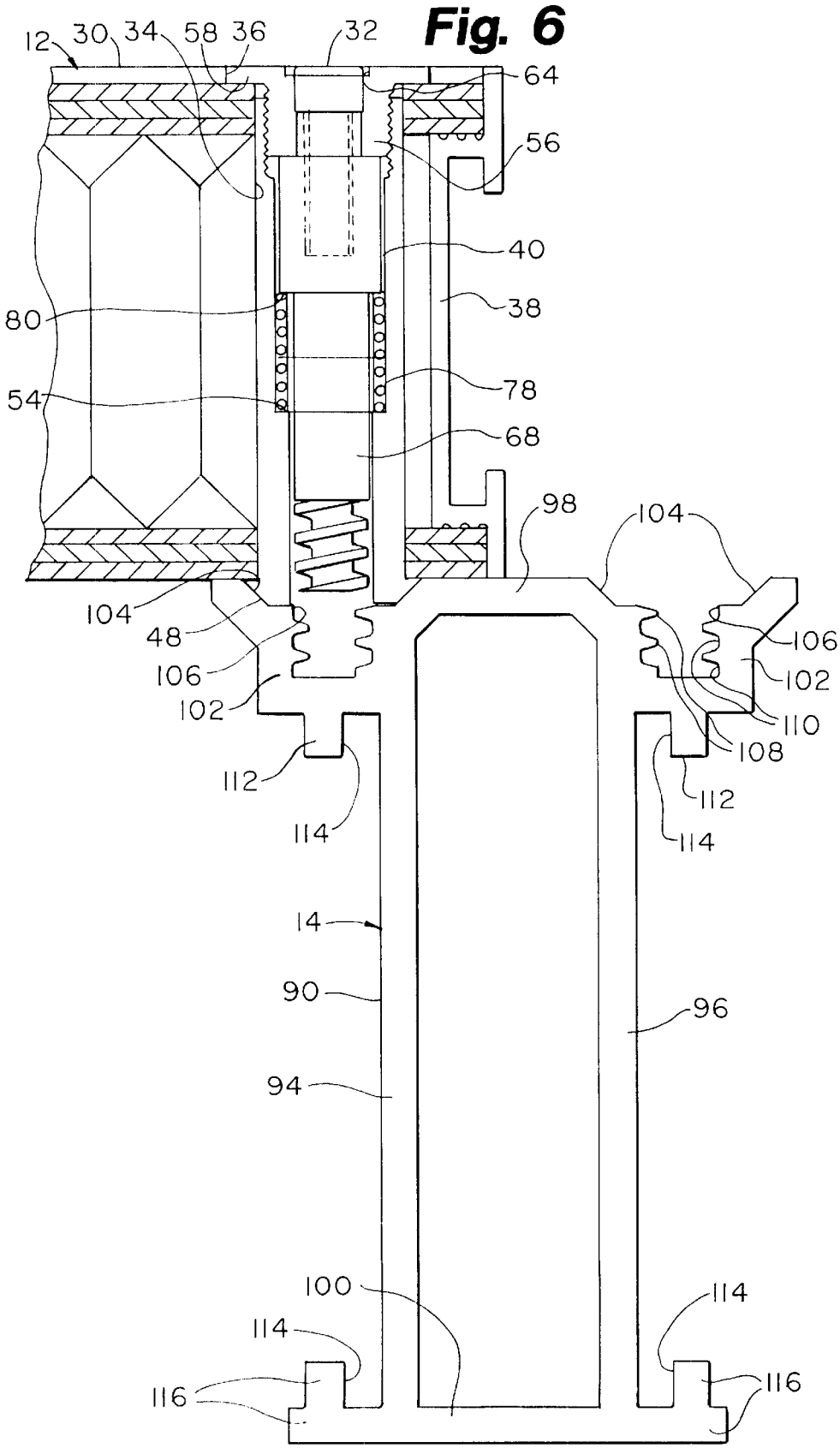
FIG. 6 is a sectional view of a deck assembly supported by a main beam with the lockdown assembly disengaged.
Figure 7:
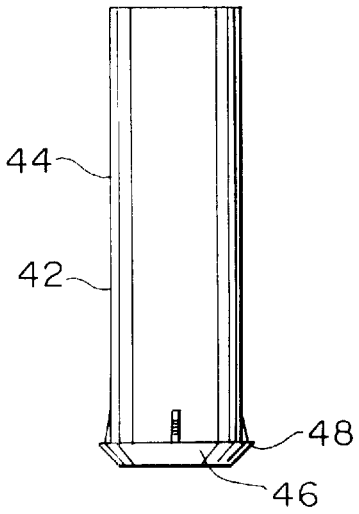
FIG. 7 is a side elevational view of a lockdown sleeve.
Figure 8:
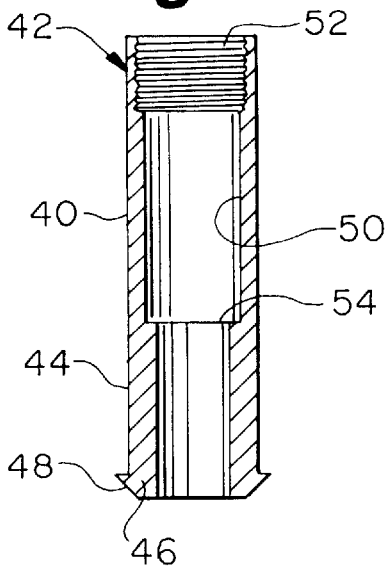
FIG. 8 is a sectional view of the lockdown sleeve of FIG. 7.

The deck assembly 12 is preferably formed of a plurality of layers. A central honeycomb material 20 is bonded between two three-eighths inch plywood sheets 22, 24. The honeycomb material 20 is preferably 2.75 inches thick. A hardwood sheet 28 comprises the upper layer of the deck assembly 12. It is the hardwood sheet 28 that presents the hardboard surface 30. Preferably, the hardwood sheet 28 is one-eighth of an inch thick and is bonded to the plywood sheet 22. An end cap 38, as depicted in FIG. 6, may be bonded to the edge margin of the deck assembly 12.

In a standard deck assembly 12, there are four lockdown bores 32 formed proximate each of the four corners of the deck assembly 12. Each of the lockdown bores 32 has a main bore 34 being a certain diameter. A counter bore 36 extends downward to a rather shallow depth from the upper margin 30 of the deck assembly 12. The counter bore 36 is a greater diameter than the main bore 34.

The lockdown bore 32 is designed to accommodate a lockdown assembly 40, as depicted in FIGS. 6–12. The lockdown assembly 40 includes a lockdown sleeve 42. The lockdown sleeve 42 has a generally cylindrical outer margin 44 that terminates in a foot 46 having a greater diameter than the outer margin 44. The foot 46 has a chamfered surface 48.

A longitudinal bore 50 is defined through the lockdown sleeve 42. The upper portion of the longitudinal bore has threads 52 cut into the bore surface. Extending downward approximately two-thirds from the upper margin of the lockdown sleeve 42 is a step 54. The diameter of the longitudinal bore 50 is reduced from the step 54 to the lower margin of the lockdown sleeve 42.

Figure 9:
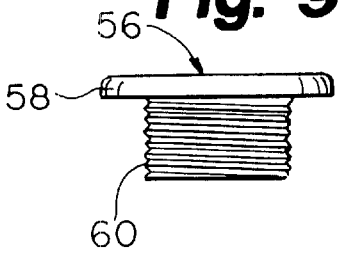
FIG. 9 is a side elevational view of a lockdown cap.
Figure 10:
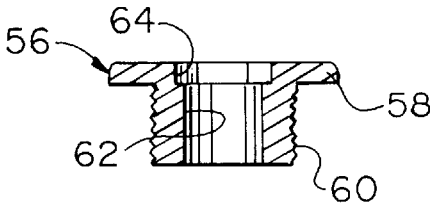
FIG. 10 is a sectional view of a lockdown cap of FIG. 9.

As depicted in FIGS. 6, 9, and 10, a lockdown cap 56 is provided to mate with the top portion of the lockdown sleeve 42. The lockdown cap 56 has a head 58 that is designed to reside within the counter bore 36 of the lock bore 32. A depending threaded shank 60 is designed to mate with the threads 52 of the lockdown sleeve 42 to secure the lockdown sleeve in the lockdown bore 32. A longitudinal bore 62 is defined through the lockdown cap 56. The longitudinal bore 62 has an upper portion formed in a hexagonal shape 64.

Figure 11:
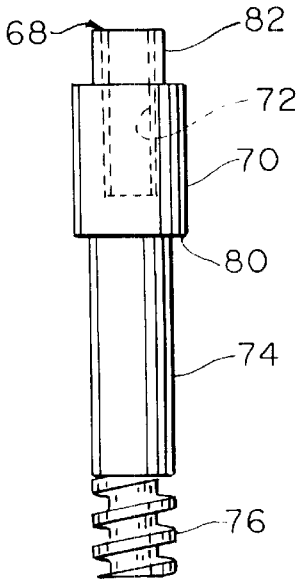
FIG. 11 is a side elevational view of the lockdown screw.

A lockdown screw 68 is depicted in FIGS. 6 and 11. The lockdown screw 68 has a head 70 presenting a cylindrical exterior surface. A blind threaded cap screw bore 72 extends from the upper margin of the head 70. An elongate depending shank 74 extends downward from the head 70. The lower portion of the depending shank 74 has an Acme thread 76 defined thereon.

The final element of the lockdown assembly 40 is the coil spring 78 depicted in FIG. 6.

The lockdown assembly 40 is assembled by first inserting the lockdown sleeve 42 upward within the lockdown bore 32. The foot 46 of the lockdown sleeve 42 projects downward from the lower margin of the deck assembly 12. The coil spring 78 is slipped over the shank 74 of the lockdown screw 68 and the lockdown screw 68 with the coil spring 78 thereon is inserted into the longitudinal bore 50 of the lockdown sleeve 42. The coil spring 78 is captured between the step 54 of the lockdown sleeve 42 and the step 80 defined between depending shank 74 and the head 70 of the lockdown screw 68. The coil spring 78 exerts an upward bias on the lockdown screw 68, biasing the lockdown screw 68 in the unlocked disposition of FIG. 6.

The lockdown screw 68 is held in position within the lockdown sleeve 42 by threading the lockdown cap 56 into the threads of the lockdown sleeve 42. This is accomplished by inserting a hexagonal wrench into the hex portion 64 of the lockdown cap 56 and turning the wrench. A cap screw 82 may then be threadedly engaged with the threaded cap screw bore 72.

Figure 12:
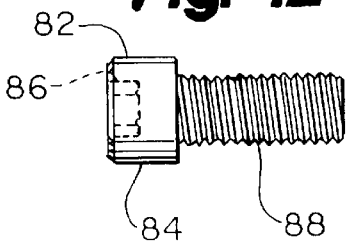
FIG. 12 is a side elevational view of a socket cap screw.
Figure 13:
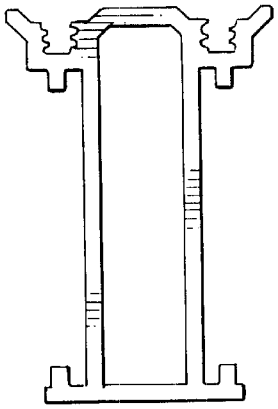
FIG. 13 is an end elevational view of a main beam.
Figure 14:
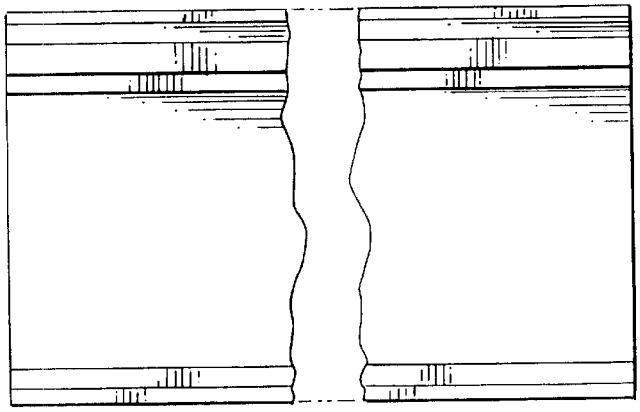
FIG. 14 is a side elevational view of a main beam.

The typical cap screw 82 is depicted in FIG. 12. The cap screw 82 has a head 84 having a hexagonal recess 86 defined therein. A threaded shank 88 depends from the head 84.

The second major component of the erectable platform 10 is the support structure 14.

The support structure 14 includes a number of components of two distinct types; main beams 90 and intermediate beams 92. Referring to FIGS. 6 and 13–15, a main beam 90 is preferably formed of an extruded aluminum structure. The main beam 90 includes two spaced apart side walls 94, 96 joined by a top 98 and a bottom 100 to define an interior cavity. The top 98 has two opposed, outwardly directed shoulders 102 that have substantially identically features. Each of the shoulders 102 has a chamfered surface 104 at the lower margin of which a portion of an Acme thread 106 is defined. Unlike most threaded apertures, which are generally cylindrical in shape, the Acme threads 106 are formed on the opposed walls of an elongate groove extending the full length of the main beam 90. The portion of the Acme thread 106 is defined by a series of lands 108 and grooves 110 that also extend the full length of the main beam 90.

Each of the two opposed outwardly directed shoulders 102 includes depending ridge 112 defines in part a slot 114 in cooperation of the outer margin of a respective side wall 94, 96. The bottom 100 also has a pair of shoulders 116. Each of the shoulders 116 has an upward directed ridge 118 that defines the second portion of the slot 114 in cooperation of the outer margin of a respective side wall 94, 96.

Figure 15:
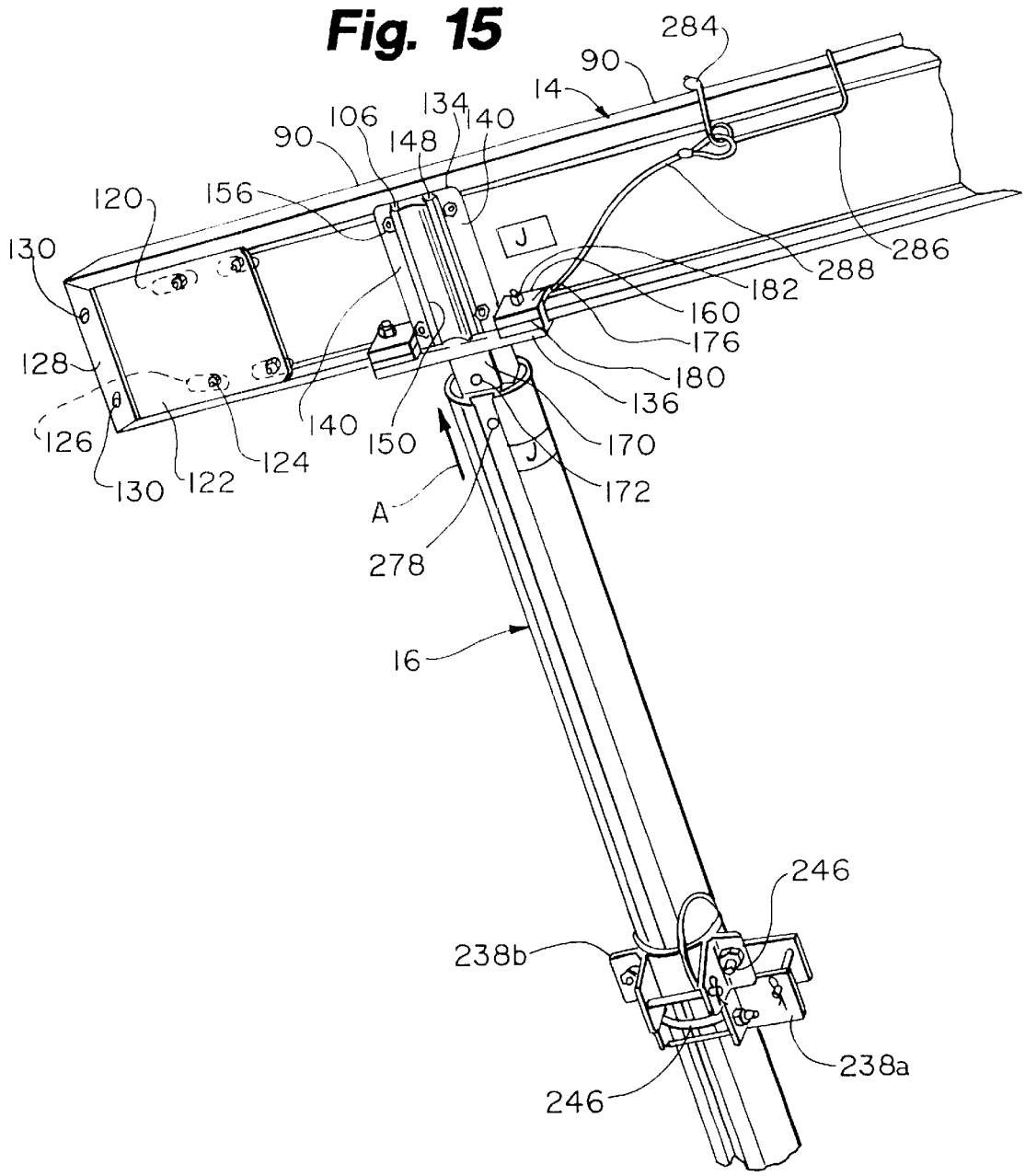
FIG. 15 is a perspective view of a column being mated to a main beam.

Referring to FIG. 15, a stage attachment bracket 120 is depicted at an end of a main beam 90. The stage attachment bracket is a plate 22 that is slipped into the slot 114. The plate 122 is affixed in place to the main beam 90 by bolts 124 that pass through bores defined in the plate 122 and thence through elongate bores 126 defined in the main beam 90. The elongate bores 126 accommodate a certain amount of longitudinal translation of the stage attachment bracket 120 relative to the main beam 90. An orthogonally disposed flange 128 forms an end margin of the plate 122. Flange 128 has a plurality of bores 130 defined therein such that a fastener can be passed through the bores 130 to couple the erectable platform 10 to an existing stage structure 19*a*, as depicted in FIGS. 2 and 38.

A number of different couplers are attached to the main beams 90 including an intermediate beam socket 134 (depicted in FIG. 15), a column bracket 136 (depicted in FIG. 15), and a brace bracket 138 (depicted in FIG. 1).

Figure 16:
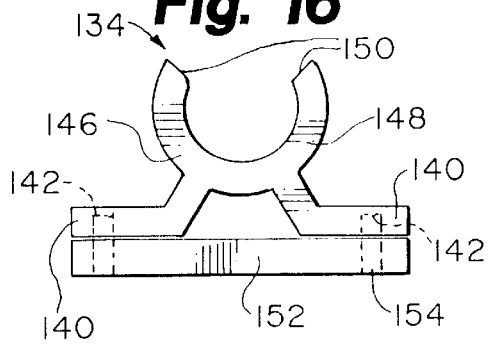
FIG. 16 is a top planform view of an intermediate beam socket.
Figure 17:
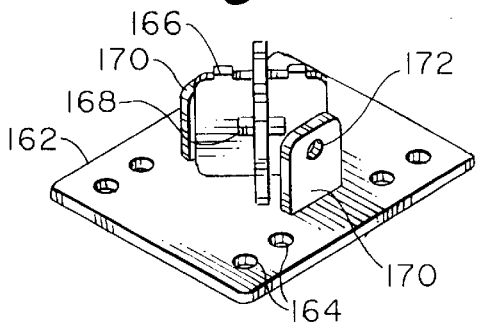
FIG. 17 is a perspective view of a column bracket.
Figure 18:
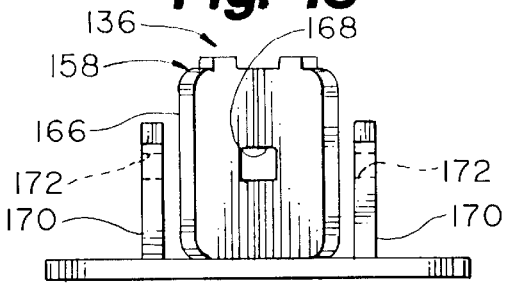
FIG. 18 is a top planform view of the column bracket.
Figure 19:
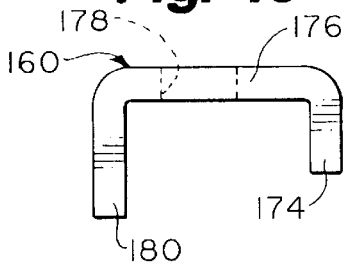
FIG. 19 is a side elevational view of a column bracket clip.

The intermediate beam socket 134 is depicted in FIGS. 15 and 16. Intermediate beam socket 134 is used for coupling the intermediate beam 92 to the main beam 90. Intermediate beam socket 134 includes a pair of spaced apart flanges 140. Each of the flanges 140 has a bore 142 defined therein. A central socket 144 joins the two spaced apart flanges 140. The central socket 144 has two spaced apart semicircular arms 146, 148 defining approximately three-quarters of a cylinder. The arms 146, 148 define an opening 150 therebetween that is preferably about ninety degrees of angular spread. A spacer 152 is positioned rearward of the intermediate beam socket 134 and includes bores 154 that are in registry with the bores 142. Intermediate beam socket 134 is affixed to the main beam 90 by four bolts passing through the bores 142, 156 and like bores (not shown) defined in the side walls 94, 96 of the main beam 90.

The column bracket 136 is depicted in FIGS. 15 and 17–19. The column bracket 136 has two major subcomponents; bracket 158 and clip 160.

The bracket 158 includes a plate 162. The plate 162 has a plurality of bores 164 defined therein. When mounted to the underside of the main beam 90, an X-shaped sleeve 166 depends from the plate 162. Central slots 168 are defined in the elements comprising the X-shaped sleeve 166.

A pair of opposed tabs 170 also depend from the plate 162 and are spaced apart from the X-shaped sleeve 166. Each of the tabs 170 has a bore 172 defined therein. The bores 172 and the slots 168 are in registry such that a pin may be passed through both the bores 172 and the slots 168 defined in the X-shaped sleeve 166.

The clip 160 is generally C-shaped, having a slot engaging lip 174 coupled to a center portion 176. The center portion 176 has a bore 178 defined therein. A second lip, the plate engaging lip 180, depends from the center portion 176.

In assembly, the plate 162 is abutted to the underside of the main beam 90. Four clips 160 are positioned such that the respective lips 174 engage the slot 114 defined in the main beam 90. The distal margin of the plate engaging lip 180 abuts the upper side margin of the plate 162. Bolts 182 are passed through the bores 164, 178 to affix the column bracket 136 to the main beam 90. In this manner, the column bracket 136 may be secured at any point along the length of the main beam 90 and the column 226 (described in greater detail below) that is coupled to the main beam 90 by the column bracket 136 is not constrained to being joined to the main beam 90 at any particular point. This affords flexibility in the assembly of the erectable platform 10.

Figure 20:
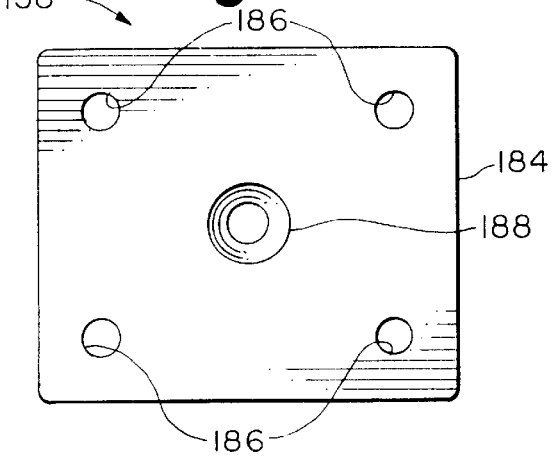
FIG. 20 is a top planform view of a brace bracket base plate.
Figure 20A:
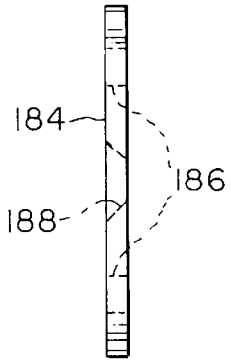
FIG. 20*a* is a side elevational view of the brace bracket base plate
Figure 21:
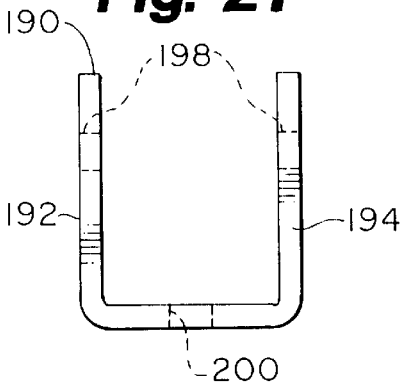
FIG. 21 is an end elevational view of a brace bracket U-bracket.
Figure 22:
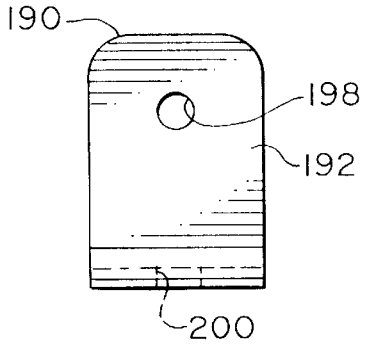
FIG. 22 is a side elevation view of the U-bracket of FIG. 21.

The brace bracket 138 is depicted generally in FIG. 1 and in more detail in FIGS. 20–22. The brace bracket 138 includes a plate 184. The plate 184 includes four clip bores 186 defined proximate each of the corners of the plate 184. A central bracket bore 188 is also defined in the plate 184. The bracket bore 188 is tapered as depicted in FIG. 21A to accept the tapered underside of the head of a bolt (not shown).

The brace bracket 138 further includes a U-shaped bracket 190 depicted in FIGS. 21 and 22. The U-shaped bracket 190 has two substantially identical arms 192, 194 joined by a center portion 196. Each of the arms 192, 194 has a bore 198 defined therein. The bores 198 are in registry. Further, the center portion has a bore 200 defined therein. In assembly, a bolt having a tapered underside head is disposed in the bracket bore 188 defined in the plate 184 such that the upper margin of the bolt is flush with the surface of the plate 184. The shank of the bolt is extended through the bore 200 and a nut is placed on the shank to affix the U-shaped bracket 190 to the plate 184. Clips 160, as described with reference to the column bracket 186, may then be used to affix the brace bracket 138 to the underside of the main beam 90 in a manner as previously described. Like the column bracket 136, the brace bracket 138 may be secured at any point along the length of the main beam 90 and the brace 228 (described in greater detail below) that is coupled to the main beam 90 by the brace bracket 138 is not constrained to being joined to the main beam 90 at any particular point. This further affords flexibility in the assembly of the erectable platform 10.

Figure 23:
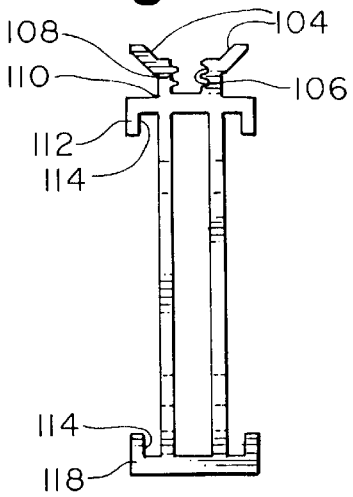
FIG. 23 Is an end elevational view of an intermediate beam.
Figure 24:
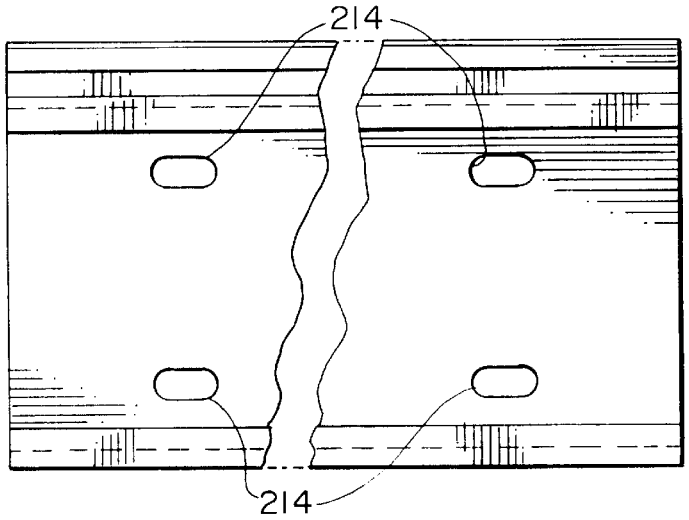
FIG. 24 is a side elevational view of the intermediate beam of FIG. 23.

The second component of the support structure 14 is the intermediate beam 92. The intermediate beam 92 includes two major sub-components beam assembly 202 and pin 204. A pin 204 is preferably used at each of the ends of a certain beam assembly 202. The beam assembly 202 is depicted generally in FIG. 38 and in detail in FIGS. 23 and 24. The beam assembly 202 is preferably extruded aluminum. Intermediate beam assembly 202 has a number of components that are similar to the components of the main beam 90 and like numerals are used to identify those components. The beam assembly 202 includes two spaced apart side walls 206, 208 connected at an upper margin by top 210 and at a lower margin by bottom 212 to define an interior cavity. The intermediate beam assembly 202 is capped by the chamfered surface 104 leading to a single Acme thread 106 formed by elongate lands 108 and grooves 110. A slot 114 is defined by a depending ridge 112 and a cooperating upward directed ridge 118 in cooperation with the exterior margin of the two spaced apart side walls 206, 208. At both ends of the beam assembly 202 a pair of elongate bores 214 are defined through the side walls 206, 208.

Figure 25:
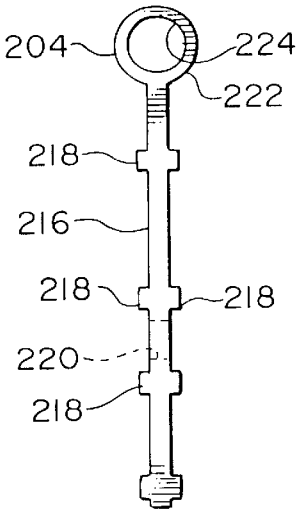
FIG. 25 is a top planform view of an intermediate beam pin.
Figure 26:
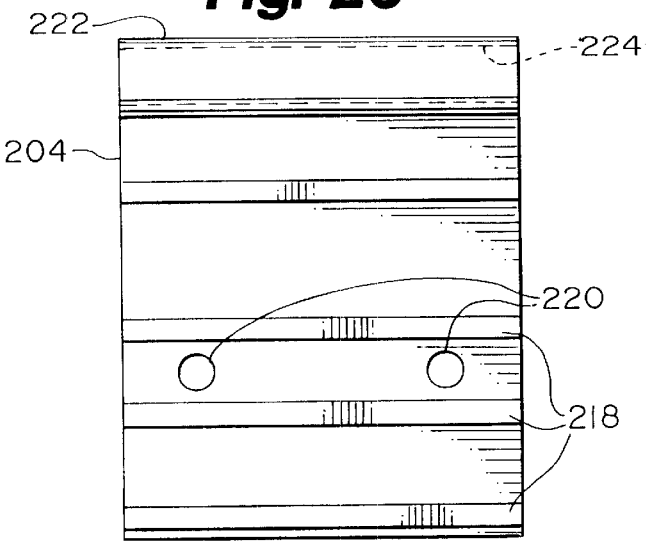
FIG. 26 is a side elevational view of the intermediate beam pin of FIG. 25.
Figure 27:
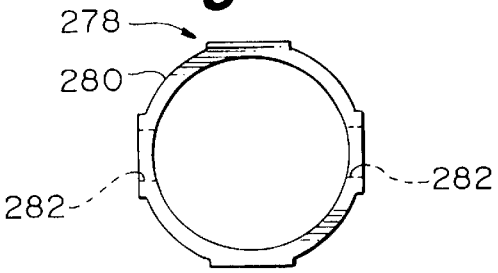
FIG. 27 is an end view of a brace.
Figure 28:
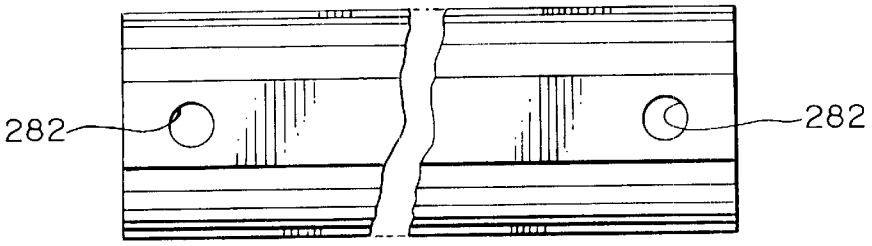
FIG. 28 is a side elevational view of the brace of FIG. 27.

The pin 204 is depicted in FIGS. 25 and 26. The pin 204 has a plate 216. The plate 216 has a plurality of ribs 218 defined thereon. The ribs 218 are designed to engage the inner margin of the side walls 206, 208 when the pin 204 is inserted into the cavity defined within the beam assembly 202. A pair of bores 220 are defined through the plate 216. The bores 220 may be brought into registry with the elongate bores 214 when the pin 204 is inserted into the beam assembly 202. A generally cylindrical ball 222 is formed at an end of the plate 216. Preferably the ball 222 has a central bore 224 defined therein.

The final component of the erectable platform 10 is the column assembly 16. The column assembly 16 includes two major subcomponents; column 226 and brace 228.

The column 226 is depicted generally in FIGS. 1, 2, and 38 and in detail in FIGS. 15 and 30–37. The column 226 is preferably an aluminum extrusion. The column 226 has a substantially square central box section 230. The box section 230 defines an interior cavity 232. A semicircular outer margin 234 is formed at each of the corners of the box section 230. The semicircular outer margins 234 define a portion of a generally circular outer margin of the column 226. The generally circular outer margin of the column 226 has a plurality of gaps 236, a gap 236 being defined between adjacent semicircular outer margins 234.

Figure 31:
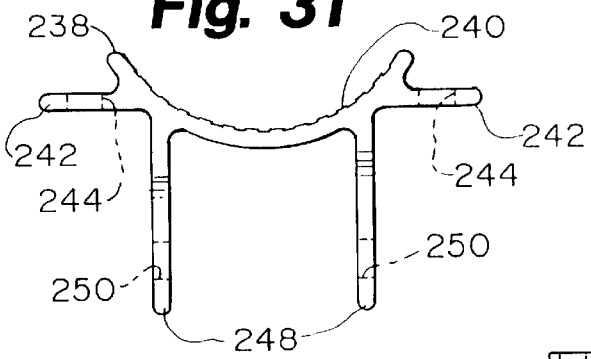
FIG. 31 is top planform view of a column bracket.
Figure 32:
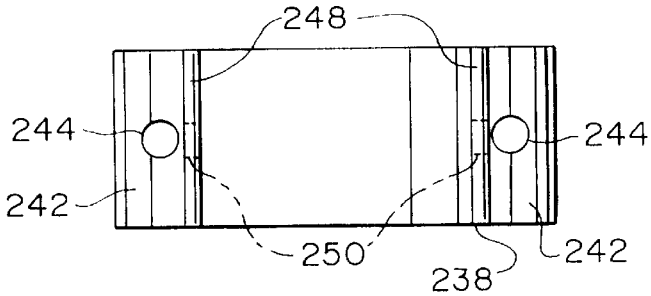
FIG. 32 is a front elevational view of the column bracket.

A column bracket 238 is used to removably affix a brace 228 to a column 226. The column bracket 238 is depicted in FIGS. 31 and 32. The column bracket 238 has a corrugated semicircular surface 240 that has a radius only slightly greater than the radius of the semicircular outer margin 234 of the column 226. A pair of tabs 242 project outward proximate each of the ends of the semicircular surface 240. Each of the tabs 242 has a U-bolt bore 244 defined therein to accommodate clamping the column bracket 238 to the column 226 by means of a U-bolt 246, as depicted in FIG. 15. A pair of larger brace tabs 248 are disposed in an orthogonal relationship to the tabs 242. Each of the brace tabs 248 has a pin bore 250 defined therein.

Figure 33:
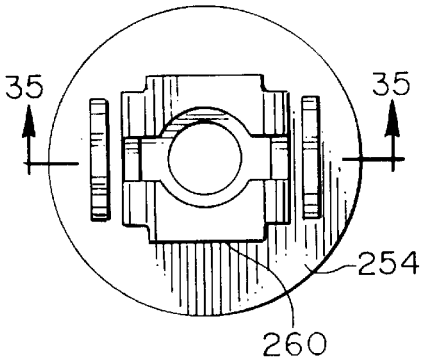
FIG. 33 is a top planforn view of a column foot insert.
Figure 34:
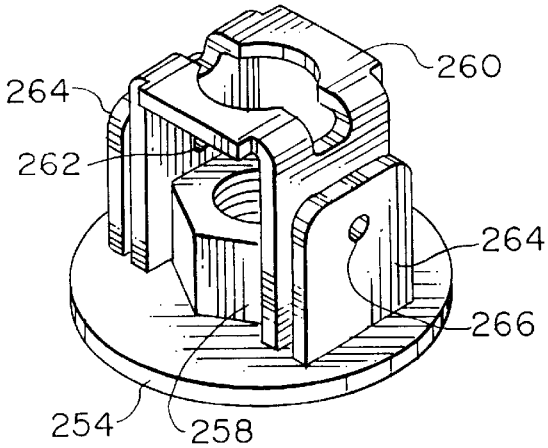
FIG. 34 is a perspective view of the column foot insert of FIG. 33.
Figure 35:
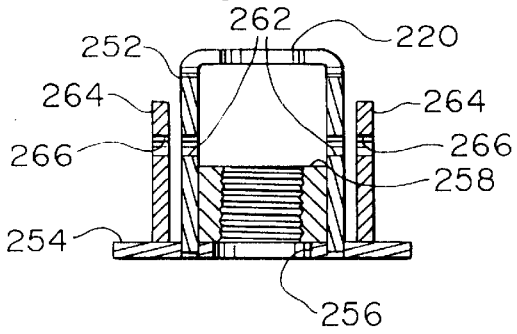
FIG. 35 is a sectional view of the column foot insert taken along lines A—A of FIG. 33.

A column foot insert 252 is depicted in FIGS. 33–35. The column foot insert 252 is utilized at the lower margin of the column 226 to affix a foot, as will be described below, to the column 226. The column foot insert has a circular plate 254. The circular plate 254 has a central bore defined therein. A relatively large nut 258 is welded to the upper surface of the circular plate 254 in registry with the bore 256. The U-shaped bracket 260 extends over the nut 258. The U-shaped bracket 260 has two bores 262 defined therein. A pair of outer brackets 264 are spaced apart from the U-shaped bracket 260. Each of the outer brackets 264 has a bore 266 defined therein. It should be noted that the bores 262 and 266 are in registry.

In assembly, the column foot insert 252 is inserted into the column 226. The U-shaped bracket 260 is received snugly within the interior cavity 232 defined within the box section 230. The outer brackets 264 lie alongside the outer margin of the box section 230. The column foot insert 252 may be secured to the column 226 by passing a bolt through the bores 262, 266 and similar bores in registry therewith defined in the box section 230 of the column 226.

Figure 36:
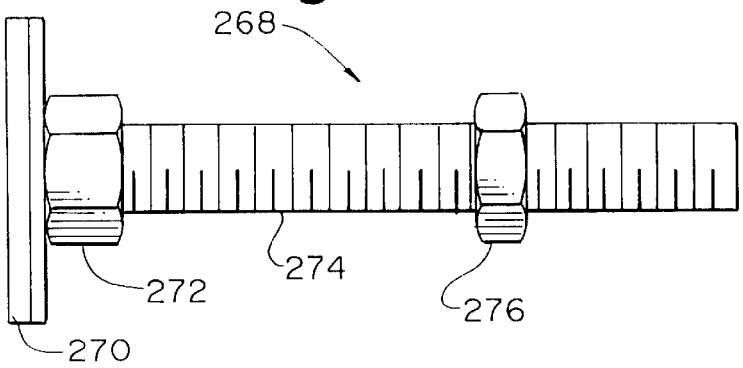
FIG. 36 is a side elevational view of a foot leveling assembly.
Figure 37:
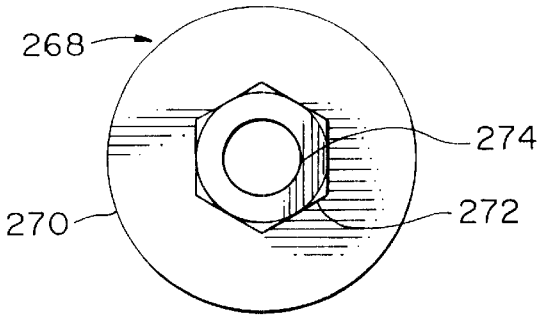
FIG. 37 is a top planform view of the foot leveling assembly of FIG. 36.

A foot leveling assembly 268 for use with the column 226 is depicted in FIGS. 36 and 37. The foot leveling assembly 268 has a circular base 270. A nut 272 is welded to a surface of the base 270. An elongate threaded stud 274 is threaded into the nut 272. The second end of the threaded stud 274 may then be threaded into the nut 258 of the column foot insert 252. The height of the column 226 may then be adjusted by turning the foot leveling assembly 268 into or out of the nut 258 as desired. When the desired height is achieved, the height may be set by jamming the jam nut 276 against the underside of the circular plate 254. The foot leveling assembly 268 provides for vernier adjustment of the height of the column 226. To grossly adjust the height of the erectable platform 10, columns 226 having generally the adjusted desired height of the erectable platform 10 are substituted for the existing columns 226. This further enhances the versatility of the erectable platform 10.

In assembly, the column 226 of the column assembly 16 is first joined to the main beam 90 of the support structure 14. Referring to FIG. 15, arrow A indicates the column 226 being slid out of the column bracket 136. To effect such joining, the X-shaped sleeve 166 is disposed within the interior cavity 232 of the box section 230 of the column 226. The two tabs 170 slide along the outer margin of the box section 230. When the upper margin of the column 226 is abutting the underside of the plate 162, the bores 278 defined in the column 226 are brought into registry with the bores 172. A pin or a bolt may then be passed through the bores 270 and 172 to affix the column 226 to the main beam 90. A suitable pin 284 is shown resting on the upper margin of the main beam 90. The pin 284 has a locking bail 286 to insure that the pin does not back out of the bores 172, 278. The pin 284 is affixed to the main beam 90 by a lanyard 288.

Next in sequence is affixing the braces 228 between the column 226 and the main beam 90. Referring to FIG. 15, it can be seen that the two column brackets 238 are orthogonally disposed. Accordingly, the column bracket 238A is disposed to couple a brace 228 to the main beam 90 while the column bracket 238B is disposed to couple a Brace 228 to an intermediate beam 92. The brace bracket 138 may be affixed to the underside of an intermediate beam 92 in much the same manner as was described with reference to affixing a brace bracket 138 to a main beam 90. To effect fixing the brace bracket 138 to the underside of the intermediate beam 92, the inner set of clip bores 186 are utilized in order to accommodate the reduced width of the intermediate beam 92 as compared to the width of the main beam 90.

A first end of the brace 228 is inserted between the arms 192, 194 of the U-bracket 190. A bolt similar to pin 284 is then inserted through the bores 198 and the bores 228. The brace 228 is then rotatably suspended from the brace bracket 138.

Figure 29:
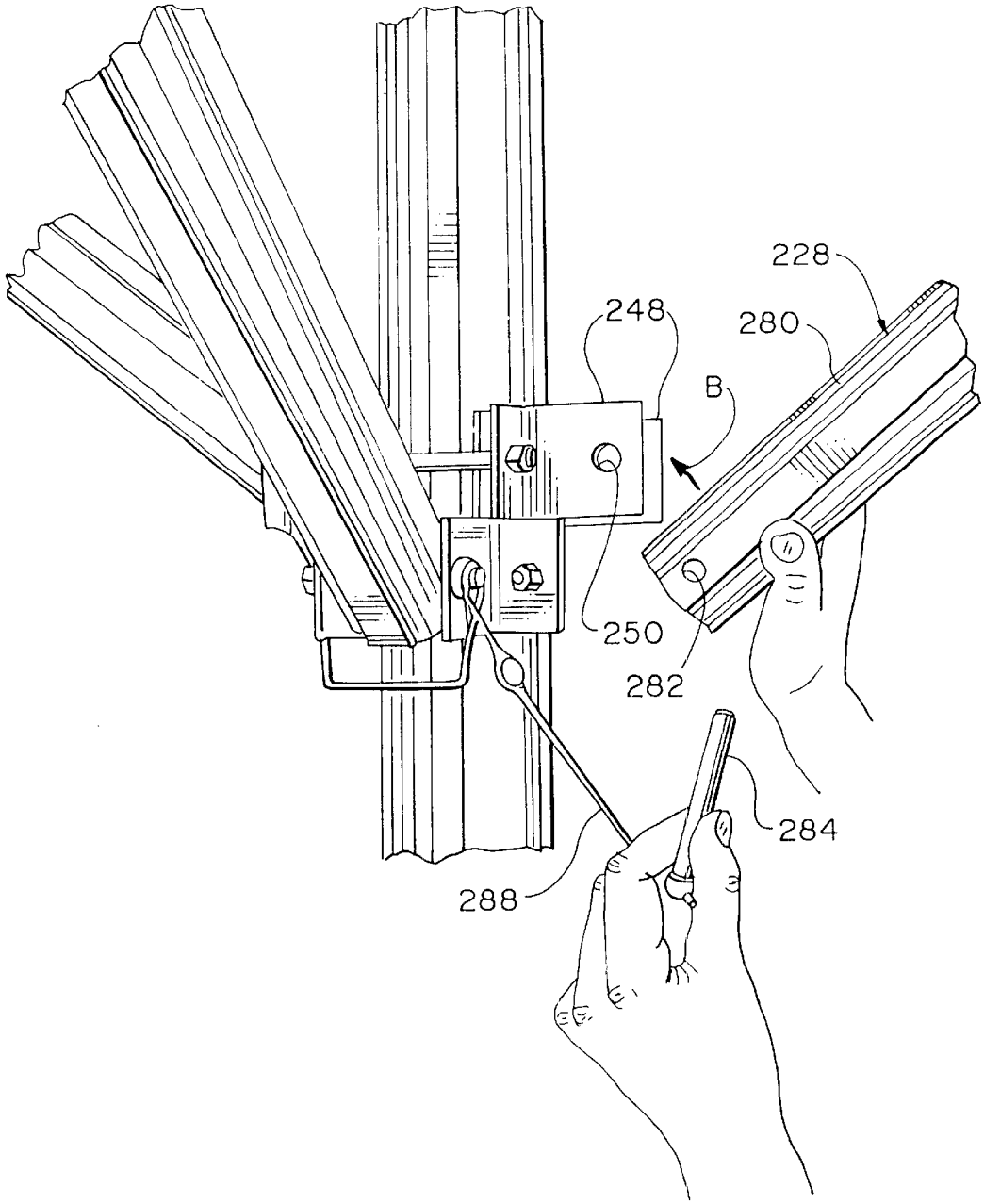
FIG. 29 is a perspective view of a brace being coupled to a column, the coupling depicted in circle 29 of FIG. 1.
Figure 30:
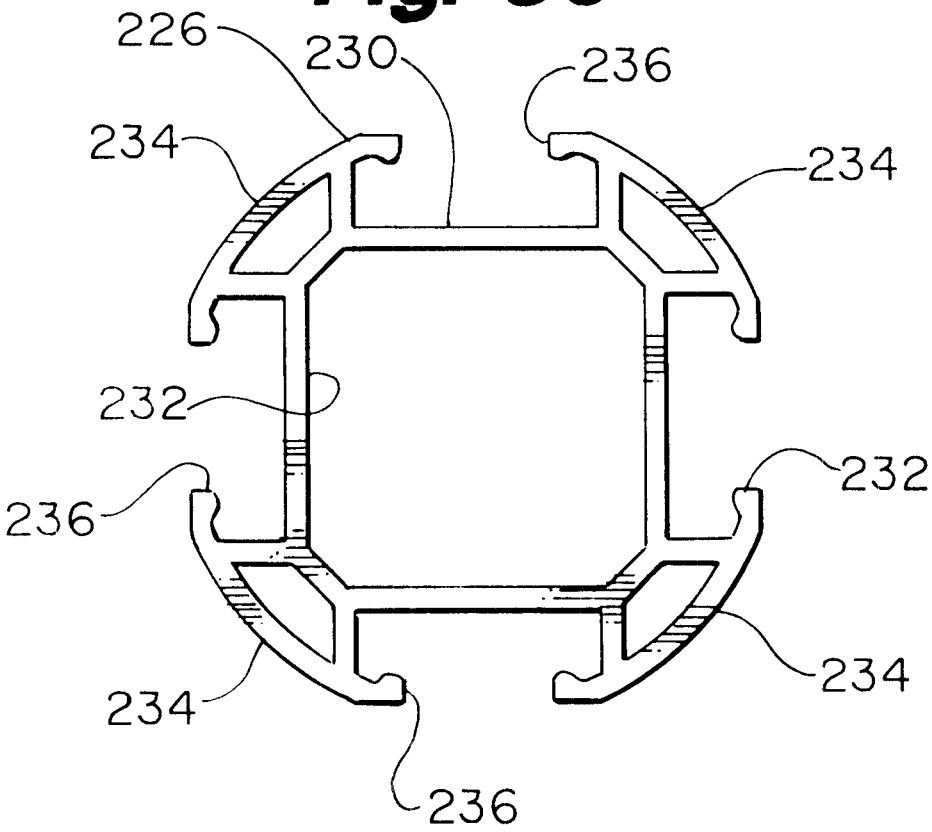
FIG. 30 is an end view of a column.

Referring to FIG. 29, the second end of the brace 228 is slipped between the spaced apart brace tabs 248 to bring the bores 250, 282 into registry with the pin bores 250. A pin 284 is then inserted through the bores 282 to removably affix the brace 228 to the column 226.

At this point, the main beams are raised on the attached columns 226 and leveled as previously described with reference to the foot leveling assembly 268.

Intermediate beams 92 with their depending braces 228 then need to be affixed between adjacent and parallel main beams 90. Referring to FIG. 38, the intermediate beams 92 are elevated slightly with respect to the main beams 90. The ball 222 of the pin 204 is then inserted (dropped) into the socket 144 of the intermediate beam socket 134 to removably couple the intermediate beam 92 to the main beam 90. An assembler in FIG. 38 can be seen making this coupling, which is effectively a ball in socket type of mating.

The opening 150 defined between the arms 146, 148 accommodates disposing the intermediate beam 92 at other than an orthogonal relationship with the main beam 90. Referring to FIG. 38 it is apparent that the intermediate beams 92 that are proximate the curvilinear pit structure 19 are not in an orthogonal disposition with respect to the main beams 90 to which they are coupled. Once the intermediate beams 92 have been coupled to the main beams 90, the overall length of intermediate beams 92 is correct and bolts positioned in the bores 220 of the pin 204 may be tightened to effect and fix the correct length of the intermediate beam 92. The braces 228 depending from the intermediate beams 92 may then be affixed to the columns 226, as previously described.

At this point, the erectable platform 10 is substantially as depicted in FIG. 1. To complete the assembly of the erectable platform 10, the various deck assemblies 12 are positioned on the beams 90, 92 and affixed thereto. Referring to FIG. 2, a deck assembly 12 is being slid into position by the assemblers. Referring to FIG. 6, the chamfered surface 104 of the main beam 90 receives the chamfered surface 48 of the lockdown sleeve 42, thereby guiding the lockdown screw 68 to a position directly over the Acme thread 106. It is important to note that since the Acme thread 106 extends the full length of the main beam 90, the deck assembly 12 need not be accurately oriented longitudinally with respect to the main beam 90 as would be required if the Acme thread 106 was a single cylindrical aperture, but only guided laterally as by the chamfered surfaces 48, 104 in order to position the Acme thread 76 of the lockdown screw 68 in position to engage the Acme thread 106. This greatly facilitates rapid assembly of the erectable platform 10.

In order to effect this threaded engagement, a hexagonal wrench is engaged with the hexagonal indent 86 in the cap screw 82. The assembler pushes down on the wrench thereby compressing the coil spring 78 and at the same time rotates the wrench to effect a rotational motion of the lockdown screw 68. The Acme threads 76 engage the Acme threads 106, thereby locking the deck assembly 12 to the main beam 90. It should be noted that a similar locking engagement may be effected between a deck assembly 12 and the single set of Acme threads 106 that cap the intermediate beam 92.

What is claimed is:

1. A platform, comprising:

at least one bay, the bay having;

at least one deck assembly, the deck assembly having a plurality of threaded couplers;

support structure having at least two spaced apart main beams and at least two intermediate beams, each of said main beams underlying each of the at least one deck assemblies in a supporting disposition, each of said main beams presenting a first elongate, upward directed threaded receiver, the threaded receiver having two spaced apart rails defining a slot between the two rails, and each of said intermediate beams extending between two of the at least two main beams and being operably removably coupled thereto; and a plurality of depending columns operably removably coupled to the support structure in a supporting disposition.

2. The platform of claim 1 including a plurality of column braces, each of said column braces having a first end and an opposed second end, the first end being pivotally couplable to the support structure and being removably operably couplable to a column.

3. The platform of claim 2 wherein each of said column braces is removably operably couplable to a column by means of a pin insertable in cooperative bores brought into registry, the cooperative bores being defined in both the column brace second end and in the column.

4. The platform of claim 2 wherein each of said columns includes a coupling bracket for coupling the column brace to the column, the column bracket being shiftable on the column, the coupling bracket including the cooperative bores defined in the column.

5. The platform of claim 1 wherein each of said intermediate beams includes at least one coupling device, the coupling device being disposed at an end of the intermediate beam for coupling to a main beam, the coupling device being selectively, longitudinally shiftable relative to the intermediate beam for adjusting an overall length dimension of the intermediate beam.

6. The platform of claim 5 wherein each of said intermediate beam coupling devices is mateable to a corresponding main beam coupling device in a ball-in-socket type coupling.

7. The platform of claim 5 wherein each of said intermediate beam coupling devices is shiftable relative to the main beam for accommodating coupling the intermediate beam to the main beam in an orthogonal disposition and in a range of angles extending to fifty degrees on either side of the orthogonal disposition.

8. The platform of claim 1 wherein the deck assembly threaded couplers are shiftable between a retracted disposition and an extended disposition, the threaded couplers being biased in the retracted disposition.

9. The platform of claim 1 wherein the deck assembly threaded couplers are actuatable from a deck assembly upper surface to engage a main beam upward directed threaded receiver in a coupled disposition.

10. The platform of claim 9 wherein the deck assembly threaded couplers are engageable with the main beam upward directed threaded receiver at substantially any location along the length of the threaded receiver.

11. The platform of claim 1 wherein the main beam threaded receiver includes a chamfered entry for aligning the deck assembly threaded couplers with threads of the threaded receiver.

12. The platform of claim 1 wherein the main beam threaded receiver rails each include a plurality of lands and grooves, the lands and grooves of a first rail cooperating with the lands and grooves of a second rail to define an elongate threaded aperture.

13. The platform of claim 12 wherein the length dimension of main beam threaded receiver rails is substantially coextensive with the length dimension of the main beam.

14. The platform of claim 13 wherein each of said main beams presents a second elongate, upward directed threaded receiver, the second elongate, upward directed threaded receiver being spaced apart from the first elongate, upward directed threaded receiver and being substantially parallel thereto.

15. The platform of claim 1 wherein each of the at least one deck assemblies includes at least a first layer presenting an upward directed wear surface, a second lower layer, and a third honeycomb layer disposed between the first and second layers.

16. A platform, comprising:

at least one bay, the bay having;

at least one deck assembly, the deck assembly having a plurality of threaded couplers;

support structure having at least two spaced apart main beams and at least two intermediate beams, each of said main beams underlying each of the at least one deck assemblies in a supporting disposition, each of said main beams presenting a first elongate, upward directed threaded receiver, the threaded receiver having two spaced apart rails defining a slot between the two rails, and each of said intermediate beams extending between two of the at least two main beams and being operably removably coupled thereto, each of said intermediate beams including at least one coupling device, the coupling device being disposed at an end of the intermediate beam for coupling to a main beam, the coupling device being selectively shiftable relative to the intermediate beam for adjusting an overall length dimension of the intermediate beam, each of said intermediate beams coupling device being mateable to a corresponding main beam coupling device in a tongue-and-groove type coupling; and a plurality of depending columns operably removably coupled to the support structure in a supporting disposition.

17. The platform of claim 16 including a plurality of column braces, each of said column braces having a first end and an opposed second end, the first end being pivotally couplable to the support structure and being removably operably couplable to a column.

18. The platform of claim 17 wherein each of said column braces is removably operably couplable to a column by means of a pin insertable in cooperative bores brought into registry, the cooperative bores being defined in both the column brace second end and in the column.

19. The platform of claim 16 wherein each of said intermediate beams coupling device is shiftable relative to the main beam for accommodating coupling the intermediate beam to the main beam in an orthogonal disposition and in a range of angles extending to fifty degrees on either side of the orthogonal disposition.

20. The platform of claim 16 wherein the deck assembly threaded couplers are shiftable between a retracted disposition and an extended disposition, the threaded couplers being biased in the retracted disposition.

21. The platform of claim 20 wherein the deck assembly threaded couplers are actuatable from a deck assembly upper surface to engage a main beam upward directed threaded receiver in a coupled disposition.

22. The platform of claim 21 wherein the deck assembly threaded couplers are engageable with the main beam upward directed threaded receiver at substantially any location along the length of the threaded receiver.

23. The platform of claim 16 wherein the main beam threaded receiver includes a chamfered entry for aligning the deck assembly threaded couplers with threads of the threaded receiver.

24. The platform of claim 16 wherein the main beam threaded receiver rails each include a plurality of lands and grooves, the lands and grooves of a first rail cooperating with the lands and grooves of a second rail to define an elongate threaded aperture.

25. The platform of claim 24 wherein the length dimension of main beam threaded receiver rails is substantially coextensive with the length dimension of the main beam.

26. The platform of claim 25 wherein each of said main beams presents a second elongate, upward directed threaded receiver, the second elongate, upward directed threaded receiver being spaced apart from the first elongate, upward directed threaded receiver and being substantially parallel thereto.

27. The platform of claim 16 wherein each of the at least one deck assemblies includes at least a first layer presenting an upward directed wear surface, a second lower layer, and a third honeycomb layer disposed between the first and second layers.

28. A platform, comprising:

at least one bay, the bay having;

at least one deck assembly, the deck assembly having a plurality of threaded couplers, the deck assembly threaded couplers being shiftable between a retracted disposition and an extended disposition, being biased in the retracted disposition and further being actuatable from a deck assembly upper surface to engage a first main beam upward directed threaded receiver in a coupled disposition;

support structure having at least two spaced apart main beams and at least two intermediate beams, each of said main beams underlying each of the at least one deck assemblies in a supporting disposition, each of said main beams presenting a first elongate, upward directed threaded receiver, the threaded receiver having two spaced apart rails defining a slot between the two rails, and each of said intermediate beams extending between two of the at least two main beams and being operably removably coupled thereto; and a plurality of depending columns operably removably coupled to the support structure in a supporting disposition.

29. The platform of claim 28 including a plurality of column braces, each of said column braces having a first end and an opposed second end, the first end being pivotally couplable to the support structure and being removably operably couplable to a column.

30. The platform of claim 29 wherein each of said column braces is removably operably couplable to a column by means of a pin insertable in cooperative bores brought into registry, the cooperative bores being defined in both the column brace second end and in the column.

31. The platform of claim 30 wherein each of said columns includes a coupling bracket for coupling the column brace to the column, the column bracket being shiftable on the column, the column bracket including the cooperative bores defined in the column.

32. The platform of claim 28 wherein each of said intermediate beams includes at least one coupling device, the coupling device being disposed at an end of the intermediate beam for coupling to a main beam, the coupling device being selectively, longitudinally shiftable relative to the intermediate beam for adjusting an overall length dimension of the intermediate beam.

33. The platform of claim 28 wherein each of said intermediate beam coupling devices is mateable to a corresponding main beam coupling device in a ball-in-socket type coupling.

34. The platform of claim 28 wherein each of said intermediate beam coupling devices is shiftable relative to the main beam for accommodating coupling the intermediate beam to the main beam in an orthogonal disposition and in a range of angles extending to fifty degrees on either side of the orthogonal disposition.

35. The platform of claim 34 wherein the deck assembly threaded couplers are engageable with the main beam upward directed threaded receiver at substantially any location along the length of the threaded receiver.

36. The platform of claim 28 wherein the main beam threaded receiver includes a chamfered entry for aligning the deck assembly threaded couplers with threads of the threaded receiver.

37. The platform of claim 28 wherein the main beam threaded receiver rails each include a plurality of lands and grooves, the lands and grooves of a first rail cooperating with the lands and grooves of a second rail to define an elongate threaded aperture.

38. The platform of claim 37 wherein the length dimension of main beam threaded receiver rails is substantially coextensive with the length dimension of the main beam.

39. The platform of claim 38 wherein each of said main beams presents a second elongate, upward directed threaded receiver, the second elongate, upward directed threaded receiver being spaced apart from the first elongate, upward directed threaded receiver and being substantially parallel thereto.

40. The platform of claim 28 wherein each of the at least one deck assemblies includes at least a first layer presenting an upward directed wear surface, a second lower layer, and a third honeycomb layer disposed between the first and second layers.

41. A platform, comprising:

at least one bay, the bay having;

at least one deck assembly, the deck assembly having a plurality of threaded couplers;

support structure having at least two spaced apart main beams and at least two intermediate beams, each of said main beams underlying each of the at least one deck assemblies in a supporting disposition, each of said main beams presenting a first elongate, upward directed threaded receiver, the threaded receiver having two spaced apart rails defining a slot between the two rails, the main beam threaded receiver rails each including a plurality of lands and grooves, the lands and grooves of a first rail cooperating with the lands and grooves of a second rail to define an elongate threaded aperture, and each of said intermediate beams extending between two of the at least two main beams and being operably removably coupled thereto; and a plurality of depending columns operably removably coupled to the support structure in a supporting disposition.

42. The platform of claim 41 wherein the main beam threaded receiver includes a chamfered entry for aligning the deck assembly threaded couplers with threads of the threaded receiver.

43. The platform of claim 41 wherein the length dimension of main beam threaded receiver rails is substantially coextensive with the length dimension of the main beam.

44. The platform of claim 43 wherein each of said main beams presents a second elongate, upward directed threaded receiver, the second elongate, upward directed threaded receiver being spaced apart from the first elongate, upward directed threaded receiver and being substantially parallel thereto.

* * * * *

UNITED STATES PATENT AND TRADEMARK OFFICE

CERTIFICATE OF CORRECTION

PATENT NO. : 6,581,339 B2
DATED : June 24, 2003
INVENTOR(S) : Thiede

It is certified that error appears in the above-identified patent and that said Letters Patent is hereby corrected as shown below:

Title page,
Item [74], delete "Skaa" and insert -- Skaar --.

Column 3,
Line 14, insert a space between "1," and "2,".

Column 4,
Lines 41-42, after "14", there should not be a new paragraph.
Line 49, delete "identically" and insert -- identical --.
Line 59, after "112", insert -- which --.

Signed and Sealed this

Sixteenth Day of September, 2003

JAMES E. ROGAN
*Director of the United States Patent and Trademark Office*